US008465105B2

(12) United States Patent
Parker et al.

(10) Patent No.: US 8,465,105 B2
(45) Date of Patent: Jun. 18, 2013

(54) CONTROL SYSTEM FOR CUTTER DRUM

(75) Inventors: Carl D. Parker, Yukon, OK (US); E. Leroy Henderson, Mustang, OK (US)

(73) Assignee: CMI Terex Corporation, Oklahoma City, OK (US)

( * ) Notice: Subject to any disclaimer, the term of this patent is extended or adjusted under 35 U.S.C. 154(b) by 1453 days.

(21) Appl. No.: 11/624,359

(22) Filed: Jan. 18, 2007

(65) Prior Publication Data

US 2008/0173740 A1 Jul. 24, 2008

(51) Int. Cl.
*E01C 23/088* (2006.01)
*E01C 23/12* (2006.01)

(52) U.S. Cl.
USPC ..... 299/39.4

(58) Field of Classification Search
USPC ..... 299/36.1, 39.1, 39.2, 39.4; 404/75, 404/90, 91, 93, 94
See application file for complete search history.

(56) References Cited

U.S. PATENT DOCUMENTS

| | | | | | |
|---|---|---|---|---|---|
| 3,694,033 | A * | 9/1972 | Rowley et al. | 299/39.4 |
| 3,888,542 | A * | 6/1975 | Gowler | 299/1.5 |
| 4,343,513 | A * | 8/1982 | Godbersen | 299/1.5 |
| 6,371,566 | B1 * | 4/2002 | Haehn | 299/1.5 |
| 6,517,281 | B1 * | 2/2003 | Rissi | 404/110 |
| 2006/0129280 | A1 * | 6/2006 | Thomas et al. | 700/275 |
| 2010/0014917 | A1 * | 1/2010 | Willis et al. | 404/93 |

FOREIGN PATENT DOCUMENTS

| | | | |
|---|---|---|---|
| DE | 2156615 | * | 5/1973 |
| FR | 2345556 | A * | 11/1977 |
| JP | 05252817 | A * | 10/1993 |

* cited by examiner

*Primary Examiner* — Sunil Singh
(74) *Attorney, Agent, or Firm* — Mayer Brown LLP

(57) ABSTRACT

A work vehicle including an engine and a transmission operatively engaging the engine. The transmission has at least one input shaft and at least one output shaft, wherein a ratio of a rotational speed of the output shaft with respect to a rotational speed of the input shaft may be changed by said transmission. The work vehicle further includes a cutter drum operatively engaging said transmission and a controller, wherein the controller selects the transmission ratio based on an input of a user of the work vehicle.

31 Claims, 4 Drawing Sheets

CONTROL SYSTEM FOR CUTTER DRUM

FIELD OF INVENTION

The present invention, differing embodiments of which are described, relates generally to the field of construction equipment, and more particularly, but not by way of limitation, to cold planers and reclaimer/stabilizer machines.

BACKGROUND

Roadways made of concrete, asphalt or other materials are subject to extreme conditions caused by weather and traffic which eventually lead to defects in the roadway surface, such as cracks and potholes. While some of these defects can be repaired by using localized patching, there comes a time when a roadway surface has become so degradated that it must be removed and replaced, or otherwise repaired or resurfaced over a large extent.

Many types of construction equipment utilize a mobile chassis with a drum mounted on an underside thereof to perform an operation on worn roadway surfaces and/or road beds. Two of such types of machines are cold planers and reclaimer/stabilizer machines. In such machines, cutting teeth are arranged on the drum in a desired configuration, such as a spiral configuration, to cut the surface and to assist, in the case of a cold planer, in picking up and transferring the removed roadway cuttings to a conveyor which, in turn, conveys the cuttings into a dump truck or other suitable vehicle for transferring the cuttings to a proper disposal or recycling location, which recycling may be at or near the work site.

As is known in the art, cold planers are used to remove layers of concrete/asphalt from existing roadways in preparation for paving operations. On the other hand, reclaimer/stabilizer machines prepare new surface material from an existing road bed by the pulverization of the road bed material. Such a machine includes a rotating cutter assembly confined within a cutter housing. The cutter housing may include a series of nozzle ports extending across the width of the housing which cooperate with spray nozzles to permit spraying of liquid additives into the cutter housing to be mixed with the salvaged material being pulverized, in order to provide the desired stabilized road bed. Alternatively, new road surfacing materials and/or liquid additives may be placed in front of the leading edge of the reclaimer/stabilizer during operation to be then mixed with the reclaimed surface material.

It is advantageous that the surface left behind by cold planer machines be of a reasonably uniform texture in nature, especially if traffic will be driven over the surface before it can be repaved. However, for many road surface repair/replacement operations, it is necessary to remove a portion of the road surface, such as the damaged portion and sections of the surface surrounding that damaged portion, to score the exposed surface so that the concrete or asphalt to be laid will more readily adhere to the exposed surface. For example, in a typical asphalt highway, the asphalt itself may have a depth of 3 to 10 inches. During renovation, it is not uncommon for up to, for example, 1 to 4 inches of the overall highway depth may be removed by the cold planer machines, with the remaining surface being scored to a depth of about 1/16 inches to about 3/16 inches. While it is desirable for such scored surfaces to be uniform in depth and pattern, non-uniform surfaces, such as wavy or grooved patterns on such surface, may arise if the ground speed of the portable machine chassis increases or decreases without making a proper adjustment in the rotational speed of the cutting drum. Thus, if ground speed is increased without increasing the speed of the cutter drum, the drum will make fewer rotations over a given linear distance, resulting in a non-uniform, wavy, grooved pattern, or even rougher road surface. Similarly, if the ground speed is decreased, without decreasing the rotational speed of the cutter drum, the drum will make greater rotations over a given linear distance, resulting in non-uniform, wavy or even rougher road surfaces. Moreover, certain states require that a consistent pattern be left by a cold planer and have requirements for gradation and blending of materials for reclaimer/stabilizer machines. Thus, changes in ground speed without the appropriate change in rotational speed of the cutter drum could alter the overall scored pattern and could alter the gradation and affect the blending characteristics of the reclaimed/stabilized material.

The need to provide a control of the cutter drum speed in relation to the travel of the machine can be seen when one considers the following. Assume a cylindrical cutter drum has a diameter of, for example, 46 inches and a length of 84 inches. Typically, rows of teeth are spread at a regular pattern on the cutter surface, such as, for example, 3 rows of teeth spaced about 48 inches circumferentially apart (which is equivalent to a spacing angle of about 120 degrees) for the drum described. The rows may have, for example, 135 individual teeth spaced a uniform linear distance apart, such as, for example 5/8 inches and at an equal projecting angle. If such a cutter operates at about 100 rpm's, each individual row of teeth will be in a position to contact the asphalt road surface about every 0.5 to 0.6 seconds. With three separate rows of teeth on the cutter drum, this means that a new row will make contact with the road surface about every 0.2 seconds. If the machine is moving at 60 feet per minute (or 1 foot per second), then each individual row of teeth will contact the road surface about every 0.6 feet. With three separate rows of teeth on the cutter drum, this means that a new row will contact the road surface about every 0.2 feet. However, if the ground speed were to change to about 90 feet per minute (about 1.5 feet per second), then each individual row of teeth will contact the pavement about every 0.9 feet. And with three separate rows of teeth on the cutter drum, this means a new row will now contact the pavement every 0.3 feet. This type of change in speed leads to an irregular, non-uniform tooth pattern, which causes a road to be rougher for automobiles that travel over the surface before it is resurfaced. Indeed, this type of speed change may lead to an undesirable wavy texture/tooth pattern in the surface that could cause vehicles that are traveling over the surface to veer toward one side of the road or the other; motorcycles are particularly prone to veer or deflect from the desired path of travel when encountering such a wavy texture.

Prior cold planer and reclaimer/stabilizer machines have previously enabled operators to provide a method of changing the cutter drum speed through the use of a multi-speed select transmission or through the process of removal and installation of sheaves of different diameters that are connected to the engine output and/or the cutter drum gearbox. However, these methods of changing drum speed are unsatisfactory. In the latter case (using sheave replacement), the work vehicle must be stopped in order to change the sheave, which is a time and labor intensive project. Even in vehicles where a multi-speed select transmission is used, the work vehicle still must remain in a very narrow speed range, or stopped altogether because the cutter drum speed cannot be changed "on the fly" with respect to the ground speed of the vehicle. Moreover, such multi-speed select transmissions typically do not contain sufficient gearing ratios to accommodate all conditions. Because changing cutter drum speed is so difficult in present cold planer and reclaimer/stabilizer machines, these machines oftentimes run at less than optimal conditions, i.e., do not operate at the proper ratio of ground speed to cutter drum speed, particularly in conditions where the work area is not flat, where the ground speed can easily vary from the speed at which the ratio is optimal. Non-optimum running conditions may also occur if the machine operator changes vehicle speed himself or where the road surface itself is such as to result in a cutting depth change.

Accordingly, there is a need for a system that will enable a machine, such as a cold planer or reclaimer/stabilizer machine, to better maintain the proper ratio of ground speed to cutter drum rotation during operation. Other needs will become apparent upon a reading of the following description, taken in conjunction with the drawings.

SUMMARY

The several embodiments described herein are designed to improve both the time and energy efficiency of a machine such as a cold planer or reclaimer/stabilizer machine. In particular, one disclosed embodiment allows the ratio of the rotational speed of the cutter drum to the ground speed of the vehicle to be held substantially constant. When used on a vehicle for roadway resurfacing, one disclosed embodiment strives to allay the concerns of states regarding the undesirable texture/tooth pattern left in the road surfaces when asphalt is removed for road resurfacing, because the substantially constant ratio reduces the presence of undesirable texture/tooth patterns in the surface of the road that has been exposed.

One disclosed embodiment improves upon the prior art by providing a control system for monitoring and regulating the ground speed and cutter drum speed of a cold planer or reclaimer/stabilizer machine. Preferably, the control system has at least two modes, a "manual" mode and an "automatic" mode. In manual mode, the cutter drum speed may be set to a specific speed, after which an operator would operate the vehicle in a manner similar to current work vehicles, keeping the vehicle within a small range of ground speeds. This is an improvement over the prior art because there would be more cutter drum speeds available to the operator, and because it would take far less time to change the cutter drum speed and ratio to ground speed. In automatic mode, the cutter drum speed would be determined by a pre-set ratio of ground speed to cutter drum speed. By varying the ground speed of the vehicle, the cutter drum speed would automatically adjust to maintain the pre-set ratio. This would allow the work vehicle to operate at optimal conditions, and would also allow an operator to ensure that certain state requirements are substantially met, such as, but not limited to, a consistent tooth pattern created by a cold planer machine, or requirements for gradation and blending of materials from a reclaimer/stabilizer machine.

As a result, this disclosed embodiment would provide a more efficient, time-saving work vehicle, saving time in the manual mode over the presently available work vehicles in the ability to change cutter drum speeds, and saving time and energy in the automatic mode by allowing the work vehicle to operate at optimal conditions at all times in any situation.

The disclosed embodiments provide additional benefits. For example, the disclosed cold planer advantageously can present a consistent texture/tooth pattern at different travel speeds. Similarly, the reclaimer/stabilizer can provide a more uniform material size to the road surface regardless of the travel speed of the vehicle.

Other objects, advantages, and features of the present disclosure will become clear from the following detailed description of the various embodiments when read in conjunction with the drawings, wherein like items have been designated with like numbers, and with the appended claims.

It will be appreciated that the Abstract, the Background, and the Summary set forth above, as well as the Brief Description of Drawings below, are provided to describe, in general terms, certain preferred aspects of the preferred embodiments of the subject matter disclosed in the Detailed Description of Preferred Embodiments, and are not intended to be, and should not be viewed as, definitional portions used to construe the limitations, or otherwise vary the scope, of the claims.

DETAILED DESCRIPTION OF PREFERRED EMBODIMENTS

Figure 1:
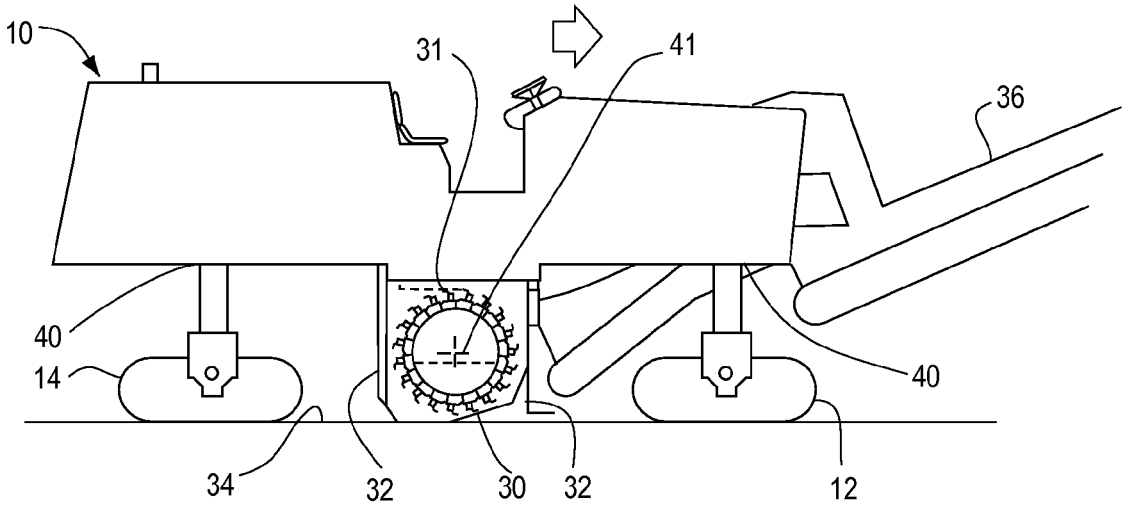
FIG. 1 is a side view of a cold planer machine in accordance with one embodiment disclosed herein.

While the present invention is capable of embodiment in various forms, there is shown in the drawings, and will be hereinafter described, one or more presently preferred embodiments with the understanding that the present disclosure is to be considered as an exemplification of the invention, and is not intended to limit the invention to the specific embodiments illustrated.

A work vehicle in the form of a cold planer machine 10, according to one embodiment of the present invention, is shown in FIG. 1. The cold planer 10 has a pair of front crawler tracks 12 and a pair of rear crawler tracks 14 that enable the machine 10 to be mobile. It will be appreciated that although dual crawler tracks are disclosed as being used in the front and rear of the cold planer machine 10, any number of crawler tracks can be used in the practice of the present invention. Also, any other structure that allows the cold planer machine 10 to move over a surface, such as pneumatic or solid wheels, can be used in the practice of the present invention.

Figure 2:
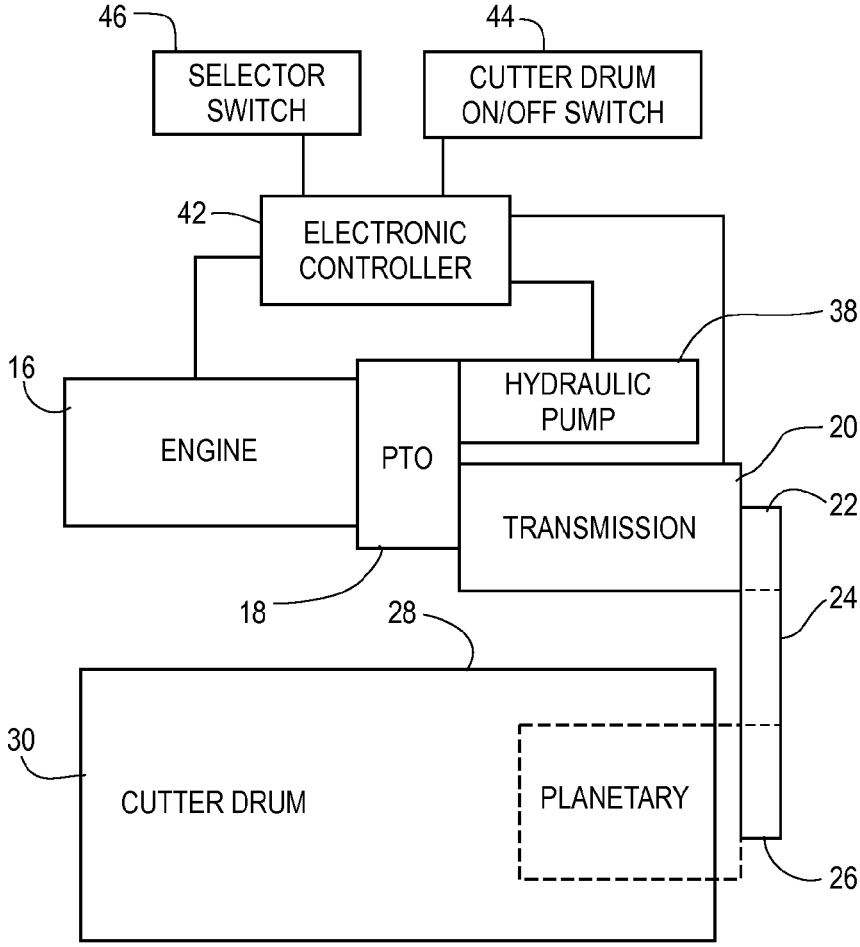
FIG. 2 is a schematic diagram of a power train of one embodiment of the cold planer of FIG. 1.

The cold planer machine 10 includes, as represented in FIG. 2, an engine 16, to which a power take off (PTO) shaft 18 is connected. The power take off shaft 18 drives an infinitely variable transmission 20. The output of the infinitely variable transmission 20 is connected to a sheave or a sprocket 22, which drives a v-belt or chain drive 24. The v-belt or chain drive 24 is, in turn, connected to a sheave or sprocket 26 on a planetary gear assembly 28, which is associated with a cutter drum 30 mounted on an underside of the machine 10. It should be noted that although planetary gears are used in one embodiment of the present invention, the invention is not limited to planetary gears. Indeed, any other type of gear assembly that provides sufficient torque and durability to cause the cutter 30 to rotate may be used in the practice of embodiments disclosed herein.

As can be appreciated, the rotational speed of the cutter drum 30 is dictated by the output of the infinitely variable transmission 20. It will be noted, however, that it is within the scope of the present invention to use any other type of transmission that provides a large range of gearing ratios such as continuously variable transmissions (CVTs), or multi-speed automatic or power shift transmissions. Indeed, any transmission with a sufficiently large number of input/output ratios can be used in the practice of the present invention, and such transmissions need not be infinitely variable. However, an infinitely variable transmission is preferred in one embodiment of the present invention.

The drum 30 includes at least one row of cutting teeth 31 along its outer periphery. Each row of cutting teeth preferably contains a plurality of individual teeth, spaced apart in a uniform fashion, such as having gaps between the edges of each tooth of about ⅜ to ⅞ inches, and preferably about ⅝ inches. The teeth are arranged such that the leading cutting edges thereof make contact with the road surface 34 as the machine 10 is in travel.

Shields 32 (see FIG. 1) are advantageously located near the leading and trailing portions of the cutter drum 30 to prevent pieces of pavement removed by the cutter drum 30 from being projected due to the momentum of the cutter drum 30 as it rotates. As the cutter drum 30 removes material from a surface 34, the removed materials are transferred to conveyors 36, which transport the removed material to a dump truck or other suitable vehicle for taking the removed material to a disposal/recycling facility, which may be at or near the work site.

The power take off shaft 18 of the machine 10 also powers a hydraulic pump 38 which forms part of a hydrostatic transmission to drive crawler tracks 12 and/or 14. Although a hydrostatic transmission is preferred to drive crawler tracks 12 and/or 14, it will be appreciated that any type of transmission can be used in the practice of the present invention for carrying out this purpose.

The depth of cut for the cutter drum 30 is controlled by hydraulic cylinders 40, which can move the machine up or down, as desired by an operator. Alternatively, each outboard end 41 of the cutter drum may be supported by hydraulic cylinders (not shown) attached to the frame of the machine 10 that enable the cutter drum 30 to be raised or lowered to a desired operating position.

In one embodiment of the invention, an electronic controller 42 coordinates control of the hydraulic pump 38 of the hydrostatic transmission, the infinitely variable transmission 20, and the engine 16. The electronic controller 42 is capable of receiving numerous user and machine inputs, including the user inputs of a cutter drum on/off switch 44 and a selector switch 46. The on/off switch 44 is preferably at the operator's station, and allows the operator to turn the cutter drum 30 on or off. In the "OFF" position, the infinitely variable transmission 20 is idled at zero rpm output and the cutter drum 30 is stationary, thus enabling an operator to transport the machine 10 with no rotation of the cutter drum 30. Upon selecting of the "ON" position, the infinitely variable transmission 20 is engaged to bring the cutter drum 30 speed up to a preset speed (in, for example, rotations per minute) at a predetermined controlled rate, regardless of the engine speed. If the user wishes to turn off the cutter drum 30 once it is rotating, the user may select the "OFF" position of the on/off switch 44, which causes the electronic controller 42 to reduce the speed of the cutter drum 30 through the infinitely variable transmission 20, at a predetermined controlled rate to avoid damage to the cutter drum drive components, until a zero rotation per minute speed is achieved. The predetermined controlled rate of speeding up or slowing down the cutter drum 30 can be advantageously programmed into the electronic controller 42 based on cutter drum size and weight, engine horsepower, and other related equipment factors. If desired, a clutching mechanism may be added to the cutter drum 30 to facilitate a stoppage of the same and to permit rotation of the cutter drum by a manual hand crank or other means during the replacement of cutter teeth. Additionally, a GPS tracking system, if desired, may be added to the machine so that a user can track the movement of the machine on a display (see FIG. 5). Alternatively, a user may plot a course into the machine's controller 42, which will in turn compare signals from the GPS navigation system to the plotted course. Based on the results of such a comparison, the controller then provides steering commands to the machine 10 in order to maintain the plotted course of the machine by automatically steering the machine, increasing or decreasing the speed of one or more of the machine's wheels or crawler tracks, or angling a machines wheels' or crawler tracks in a desired direction through use of electronic or hydraulic actuators made part of the machines steering mechanism.

The electronic controller 42 also receives real-time feedback from the machine in the form of operating information, such as engine speed, travel speed, cutter drum speed, and infinitely variable transmission output speed, through the use of sensors placed throughout the machine 10.

Figure 5:
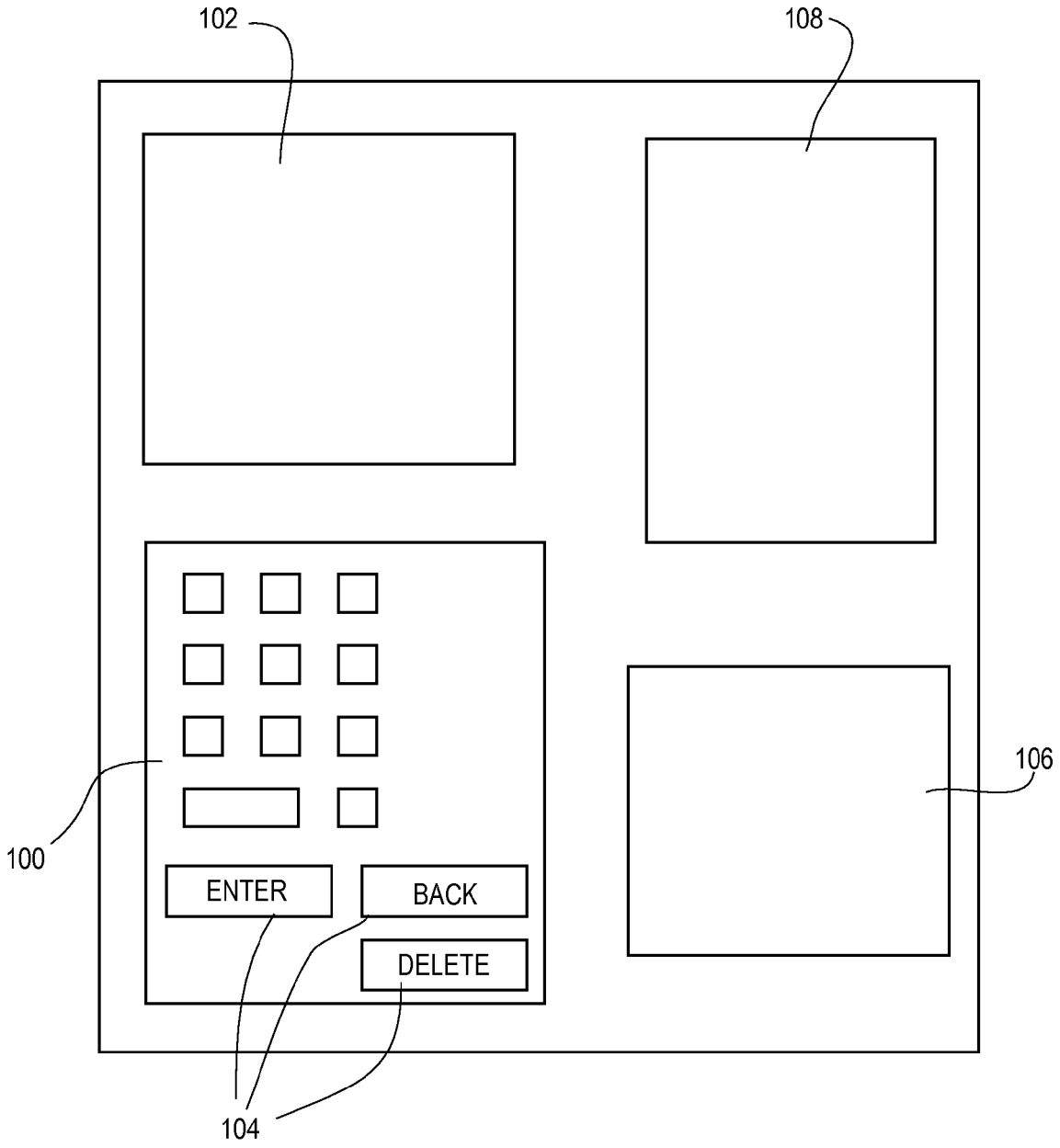
FIG. 5 is a diagram of an example of a data entry key pad for use with one embodiment disclosed herein.

Preferably, the electronic controller 42 is, or is connected to, a microprocessor with a user interface that can be used by the operator to input the relevant operating parameters upon equipment start-up. For example, one embodiment of the electronic controller 42 is depicted in FIG. 5. In this embodiment, the controller has a numeric, or alpha-numeric, keypad 100, a display 102, and other control options 104, such as enter, back, and delete keys. Upon start-up of the machine, the operator will set the machine configuration, preferably in response to a series of messages provided via the display 102. A list 106 of the parameters that could be changed by the operator is displayed for operator reference.

Figure 6:
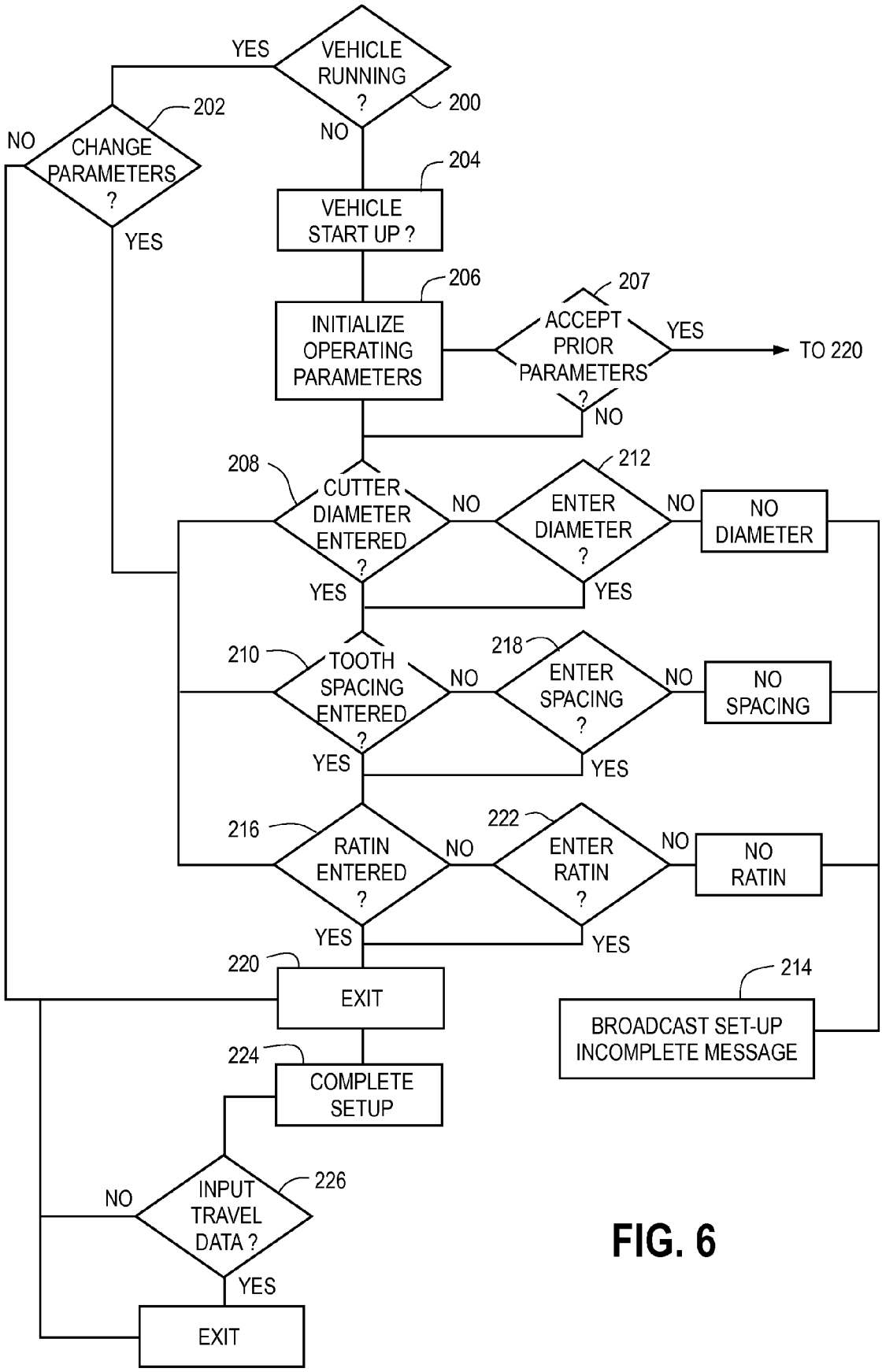
FIG. 6 is a flowchart of a setup and operational procedure for use with one embodiment disclosed herein.

FIG. 6 is a flowchart of a setup and operational procedure that can be used with one embodiment of the present invention. Upon power up of the microprocessor, sensors will determine if the vehicle engine is started, as at 200. If the vehicle has not been started, the operator will start the vehicle, at 204, and the operating parameters will be initialized, at 206. The operator will then be prompted on the display 102 to change parameters, for example, beginning with the cutter drum diameter 208. If there already is a cutter drum diameter entered and the operator chooses to keep it, the operator will be prompted on the display 102 to enter the tooth spacing 210. If there is no diameter entered or the operator chooses to reject the previous entry, the operator will be prompted on the display 102 to enter the diameter 212. If the operator does not enter a diameter, a broadcast setup incomplete message will be displayed 214 on display 102. If the operator enters a diameter, the operator will then be prompted to enter the tooth spacing 210. Similarly, an operator can choose to either keep the tooth spacing already entered, moving on to the engine speed/cutter drum speed or cutter drum speed/ground speed ratios 216, or change the spacing at 218. If there is no tooth spacing entered and the operator does not enter one, the broadcast setup incomplete message 214 will be displayed on display 102. If the operator enters a tooth spacing, he will then be prompted to enter the engine speed/cutter drum speed or cutter drum speed/ground speed ratio 216. Advantageously, the ratio 216 permits the operator to control the pattern that is cut into the road surface. This is accomplished by the fact that when, in automatic mode for example, the operator increases or decreases the ground speed, the controller automatically adjusts the cutter drum speed to maintain the cutter drum speed/ground speed ratio that the operator entered into the controller during initial setup. Alternatively, the operator could instead increase or decrease the cutter drum speed, resulting in the controller making an automatic adjustment of the ground speed to maintain the previously entered ratio. As such, when in automatic mode, each row of cutter drum teeth will still make contact with the work surface in the same linear distance of travel, regardless of the ground speed or cutter drum speed, resulting in a uniform pattern being cut into the road surface.

If the operator chooses to keep the engine speed/cutter drum speed ratio or the cutter drum speed/ground speed ratio, the program will exit at 220 and "Complete setup" will be displayed at 224. Alternatively, the operator can enter a new engine speed/cutter drum speed ratio or cutter drum speed/ground speed ratio at step 222, after which the program will exit at 220 and setup will be complete. Finally, after operating parameter initialization, at 206, the process flow may provide for the operator to accept all previously entered parameters, at 207, and if the operator so accepts, the process will advance to exit 220.

If upon microprocessor startup, the sensors determine that the vehicle is already started, at 200, the operator will be prompted to choose to change parameters 202. If the operator chooses no, the operator will exit the program 220 and a "Complete Setup" message will be displayed 224. If the operator chooses to change parameters, a similar procedure beginning with cutter diameter entry 208, as above, will be followed.

The current settings as input to the controller 42 are displayed on a status window 108 (FIG. 5), so that an operator can determine if the parameters need to be changed. With this information entered into the controller 42, the microprocessor component of the controller can then control the engine speed and the infinitely variable transmission 20 to maintain the operation of the machine within the desired parameters.

In the event the machine 10 is provided with a GPS navigation system that communicates positional data to the controller 42, after setup of operating parameters is complete, the operator may input travel directional data, at step 226. This input may be, for example, longitude/latitude "from" and "to" data. When so inputted, the controller receives real time positional data from the GPS receiver, which is then compared to the inputted travel directional data to provide directional feedback data in order to control engine and crawler track speeds as well as crawler track or wheel steering paths. This enables the machine 10 to be steered in an automatic, or substantially automatic, mode to maintain a desired course.

If it is desired to change the parameters, the operator may stop the vehicle, disengage the cutter so that it is no longer rotating and then proceed to enter new operating parameters using the keypad 100. Advantageously, the microprocessor can also store the parameters of numerous cutters and cutter teeth configurations that can be recalled when the operator configures the operating parameters of the machine, thus allowing rapid configuration of such parameters.

A selector switch 46, which is also preferably located at the operator's station, allows the operator to select between a manual mode and an automatic mode. In the manual mode, an operator may use keypad 100 to set a desired ratio of engine speed to cutter drum speed (in rpm units), within a range of available ratios. In a preferred embodiment, the range of ratios would be from about a 17:1 engine speed to cutter drum speed, to about a 25:1 engine speed to cutter drum speed. This operator setting causes the electronic controller 42 to maintain the desired ratio by controlling the infinitely variable transmission 20. Thus, for example, if the desired ratio between the engine speed and cutter drum speed is 20:1, then the electronic controller 42 will maintain this ratio as the engine speed may increase or decrease during operation. Accordingly, an increase in engine speed of 100 rpm will create an increase in cutter drum speed by 5 rpm. The manual operating position can be used with or without a travel load controller, which, as is known in the art, varies the travel speed of the machine, within defined or pre-determined limits, to permit operation of the machine at an engine horsepower approaching its maximum.

When the selector switch 46 is in automatic mode, the electronic controller 42 automatically changes the engine speed/cutter drum speed ratio in the infinitely variable transmission 20 in response to any changes in ground travel speed, thereby automatically adjusting the cutter drum speed in order to maintain the desired tooth pattern on the roadway surface. For instance, if the electronic controller 42 receives input from a sensor that the ground speed of the vehicle has increased by 5 feet per second, the controller 42 will automatically calculate and implement the necessary engine/transmission ratio in order to increase the cutter drum speed at an appropriate rate to maintain the preset cutter drum speed/ground speed ratio and the desired tooth pattern that is cut into the roadway surface. As can be appreciated, the infinitely variable transmission 20 allows the cold planer machine 10 to make minute adjustments in the cutter drum 30 speed based on slight changes in the ground speed. As with the "manual" setting, the "automatic" position can be used with or without a travel load controller. It should be noted that, in addition to changing the cutter drum speed to maintain the cutter drum speed/ground speed ratio and thereby maintaining a desired tooth pattern, the electronic controller 42 may also change the ground speed of the machine 10 to achieve the same result. For instance if the cutter drum 30 is already rotating at maximum speed (which may be a speed dependent on the strength of the cutting teeth attached to the drum, or the maximum permissible tooth speed to avoid overheating), and an operator inputs a request to increase the ground speed of the cold planer 10, the electronic controller 42 in a preferred embodiment will prevent such request from being implemented and will restrict further ground speed increases. Thus, in the automatic mode, the electronic controller 42, by having the ability to control both the ground speed and the cutter drum speed can maintain a substantially consistent tooth pattern while operating within a wide range of ground speeds.

Figure 3:
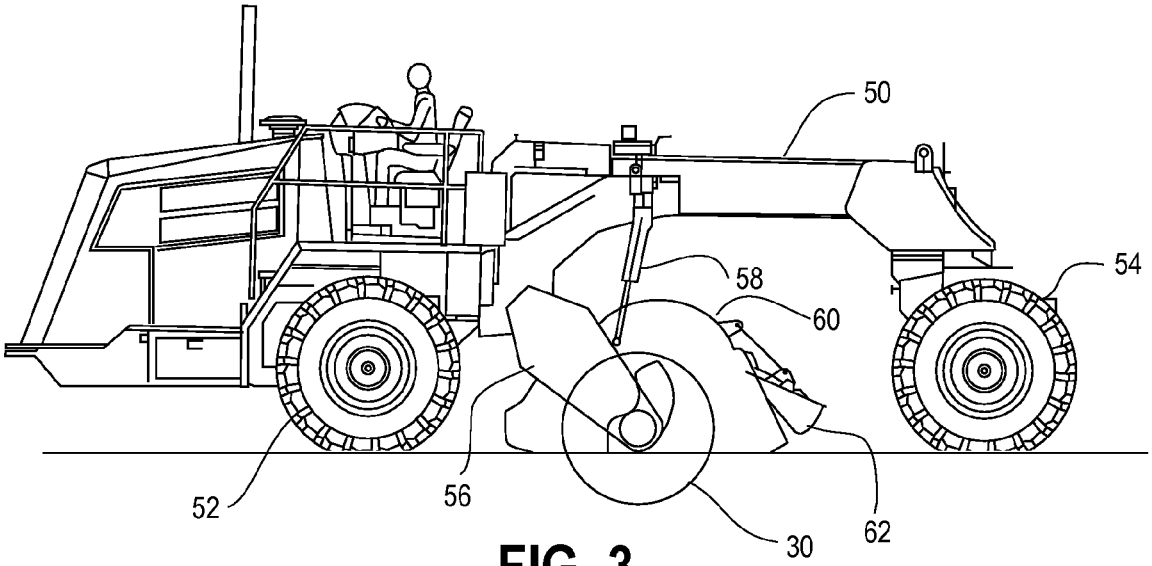
FIG. 3 is a side view of a reclaimer/stabilizer machine in accordance with one embodiment disclosed herein.
Figure 4:
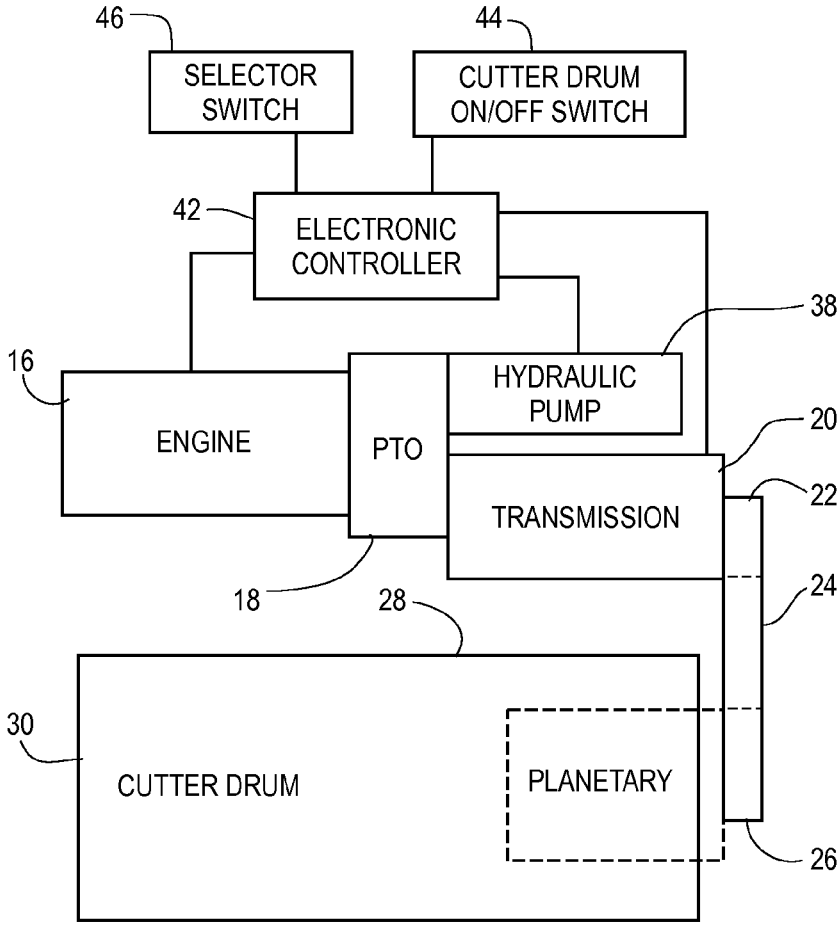
FIG. 4 is a schematic diagram of a power train of one embodiment of the reclaimer/stabilizer machine of FIG. 3.

The embodiments disclosed herein can be applied in any number of work vehicles, including a reclaimer/stabilizer machine 50, as shown in FIG. 3. For convenience, like parts have been given like numbers in FIGS. 2 and 4. The reclaimer/stabilizer machine 50 has a pair of front wheels 52 and a pair of rear wheels 54. Also, any other structure that allows the reclaimer/stabilizer machine 10 to move over a surface, such as crawler tracks or solid wheels can be used in the practice of the present invention.

The machine also includes a cutter drum 30. The cutter drum 30 is connected to a pivoting arm 56 in order to allow the cutter drum to be raised or lowered from a road surface. Also, any other structure that allows the cutter drum to be raised and lowered from a road surface can be used in the practice of an embodiment of the matter disclosed herein. The pivoting arm 56 is raised or lowered by use of a hydraulic piston 58, which is attached between the frame of the machine 10 and the pivoting arm 56. A cutter housing 60 keeps material from being ejected away from the machine and also serves to define an area for blending of materials. A series of nozzles 62 may be mounted to spray liquid additives/conditioners through a series of nozzle ports within cutter housing 60. Alternatively, new road surfacing materials and/or liquid additives may be placed in front of the leading edge of the reclaimer/stabilizer during operation to be then mixed with the reclaimed surface material.

The reclaimer/stabilizer machine 50 includes an engine 16, to which power take off shaft 18 is connected. The power take off shaft 16 drives an infinitely variable transmission 20. The output of the infinitely variable transmission 20 is connected to a sheave or a sprocket 22, which drives a v-belt or chain drive 24. The v-belt or chain drive 24 is, in turn, connected to a sheave or sprocket 26 on a planetary gear assembly 28, which is located within a cutter drum 30 mounted on a pivoting arm 56 on an underside of the machine 50. It should be noted that although planetary gears are used in one embodiment of the present invention, the invention is not limited to planetary gears. Indeed, any other type of gear assembly that provides sufficient torque and durability may be used in the practice of an embodiment of the matter disclosed herein.

Similar to the previously described embodiment, the rotational speed of the cutter drum 30 is dictated by the output of the infinitely variable transmission 20. It will be noted, however, that it is within the scope of the present invention to use any other type of transmission that provides a large range of gearing ratios such as continuously variable transmissions (CVTs). Indeed, any transmission with a sufficiently large number of input/output ratios can be used in the practice of the present invention, and such transmissions need not be infinitely variable. However, an infinitely variable transmission is preferred in one embodiment of the present invention.

The power take off shaft 18 of the machine 50 also powers a hydraulic pump 38 which forms part of a hydrostatic transmission to drive wheels 52 and/or 54. Although a hydrostatic transmission is preferred to drive wheels 52 and/or 54, it will be appreciated that any type of transmission can be used in the practice of the present invention for carrying out this purpose. As is known in the art, the depth of cutter drum 30 is controlled by a hydraulic piston 58, which can move the cutter drum 30 up or down through the pivoting arm 56, as desired by an operator. Also, any other structure that allows the cutter drum to move up and down may be used in the practice of an embodiment of the matter disclosed herein.

In one embodiment of the invention, the reclaimer/stabilizer machine will use the same electronic controller arrangement as shown in FIG. 2 and described herein. The reclaimer/stabilizer machine will also use, in one embodiment, the same data entry key pad shown in FIG. 5 and described herein and the setup and operational procedures shown in FIG. 6 and described herein. Although the discussions of FIGS. 2, 5 and 6 are not repeated with respect to the reclaimer stabilizer machine, it will be understood that such Figures and the discussions of them apply equally to the reclaimer/stabilizer machine and are incorporated by reference with respect to the reclaimer/stabilizer machine.

The foregoing description of preferred embodiments have been presented for purposes of illustration and description, and is not intended to be exhaustive or to limit the invention to the precise form disclosed. The description was selected to best explain the principles of the invention and their practical application to enable others skilled in the art to best utilize the various embodiments and various modifications as are suited to the particular use contemplated. It is intended that the scope of the invention not be limited by the specification, but be defined by the claims set forth below.

What is claimed is:

1. A work vehicle adapted for use in pavement removing operations comprising:

a self propelled chassis;

an engine mounted to said chassis;

a first transmission operatively engaging said engine, said first transmission having at least one input shaft driven by said engine and at least one output shaft, wherein a ratio of a rotational speed of said output shaft with respect to a rotational speed of said input shaft may be selectively changed in said first transmission;

a cutter drum having a plurality of cutter teeth located around the outer periphery of said drum, said cutter drum operatively engaging said output shaft of said first transmission, wherein a rotational speed of said cutter drum is proportional to the rotational speed of said output shaft of said first transmission; and an electronic controller connected to said first transmission, wherein said electronic controller selects said ratio in said first transmission based on an input of a user of said work vehicle.

2. The work vehicle of claim 1, wherein said electronic controller is selectively placeable in a manual or automatic mode based on the input of said user.

3. The work vehicle of claim 2, wherein when said electronic controller is placed in said manual mode, said electronic controller maintains a desired ratio between a rotational speed of said engine and the rotational speed of said cutter drum, based on the input of said user.

4. The work vehicle of claim 2, wherein when said electronic controller is placed in said automatic mode, said electronic controller maintains a desired pattern created by said cutter drum on a work surface by maintaining a desired ratio between said cutter drum speed and a ground speed of said work vehicle, based on an input of said user.

5. The work vehicle of claim 2, wherein said work vehicle further comprises a second transmission operatively engaging said engine, wherein the rotational speed of the output shaft of said second transmission is directly proportional to the groundspeed of said work vehicle.

6. The work vehicle of claim 5, wherein said output shaft of said second transmission drives a plurality of crawler tracks or wheels attached to said chassis.

7. The work vehicle of claim 5, wherein said second transmission is a hydrostatic transmission.

8. The work vehicle of claim 5, wherein when said electronic controller is placed in said automatic mode, said electronic controller maintains a desired pattern created by said cutter drum on a work surface by varying the groundspeed of said work vehicle in order to maintain a user inputted ratio between the rotational speed of said cutter drum and the ground speed of said work vehicle.

9. The work vehicle of claim 5, wherein when said electronic controller is placed in said automatic mode, said electronic controller maintains a desired pattern created by said cutter drum on a work surface by varying the rotational speed of said cutter drum in order to maintain a user inputted ratio between the rotational speed of said cutter drum and the ground speed of said work vehicle.

10. The work vehicle of claim 1, wherein said work vehicle is a cold planer machine or a reclaimer/stabilizer machine.

11. The work vehicle of claim 1, wherein said electronic controller is a microprocessor.

12. The work vehicle of claim 1, wherein said first transmission is an infinitely variable transmission or a continuously variable transmission.

13. The work vehicle of claim 1, wherein said output shaft of said first transmission is connected to said cutter drum by a v-belt or a chain.

14. The work vehicle of claim 1, wherein said input is a desired ratio between the cutter drum speed and the ground speed of said work vehicle.

15. The work vehicle of claim 1, wherein said input is a desired ratio between the engine speed and the cutter drum speed.

16. The work vehicle of claim 1, wherein said input is a desired pattern created by said cutter drum in a work surface.

17. The work vehicle of claim 1, wherein said input is effectuated through a keypad mounted on said work vehicle.

18. The work vehicle of claim 1, where a GPS tracking system is mounted to said work vehicle to monitor the travel path of the work vehicle and convey positional data to said electronic controller.

19. The work vehicle of claim 18, wherein said electronic controller may be programmed with directional travel path data that will instruct said work vehicle to automatically travel along a path determined by a user defined input.

20. The work vehicle of claim 19, wherein said input is in the form of longitude/latitude "from" and "to" data.

21. The work vehicle of claim 19, wherein said electronic controller compares the positional data from said GPS to said inputted directional travel data, the results of which are used by said electronic controller to make automatic adjustments to said vehicle ground speed and said vehicle steering in order to maintain said predetermined path.

22. A work vehicle comprising:

an engine;

a first transmission engaging said engine, said first transmission having a plurality of input/output ratios;

a cutter drum connected to said first transmission, wherein an output of said first transmission is directly proportional to the rotational speed of said cutter drum;

a second transmission engaging said engine, said second transmission having a plurality of input/output ratios, wherein an output of said second transmission is directly proportional to the groundspeed of said work vehicle; and an electronic controller, wherein said electronic controller selects the input/output ratios of said transmissions based on the input of a user of said work vehicle, wherein said electronic controller is selectively placeable in a manual or automatic mode based on the input of said user.

23. The work vehicle of claim 22, wherein when said electronic controller is placed in said manual mode, said electronic controller maintains a ratio between a speed of said engine and a speed of said cutter drum.

24. The work vehicle of claim 22, wherein when said electronic controller is placed in said automatic mode, said electronic controller maintains a desired pattern created by said cutter drum on a work surface by adjusting said input/output ratios in said first and second transmissions, so as to maintain a corresponding predetermined ratio of cutter drum speed to ground speed associated with the desired pattern.

25. The work vehicle of claim 22, wherein said electronic controller is a microprocessor.

26. The work vehicle of claim 22, wherein said first transmission is an infinitely variable transmission.

27. The work vehicle of claim 22, wherein said first transmission is a continuously variable transmission.

28. The work vehicle of claim 22, wherein said input is effectuated through a keypad mounted on said work vehicle.

29. The work vehicle of claim 22, wherein said output of said first transmission is connected to said cutter drum by a v-belt or by a chain.

30. A work vehicle comprising:

an engine;

a first transmission connected to said engine, said first transmission having a plurality of input/output ratios;

a cutter drum connected to an output of said first transmission;

a hydrostatic transmission connected to said engine, wherein an output of said hydrostatic transmission is directly proportional to the groundspeed of said work vehicle, and wherein said hydrostatic transmission drives a plurality of wheels or crawler tracks;

an electronic controller, wherein said electronic controller selects the input/output ratio of said first transmission based on the input of a user of said work vehicle, wherein said electronic controller is selectively placeable in a manual or automatic mode based on the input of said user, wherein in said manual mode said electronic controller maintains a ratio between a speed of said engine and a speed of said cutter drum, and in said automatic mode said electronic controller maintains a desired ratio between the rotational speed of said cutter drum and a ground speed of said work vehicle by selecting an appropriate input/output ratio in said first transmission in response to a change in the ground speed of said work vehicle;

a keypad connected to said electronic controller, wherein said keypad may be used to enter said user inputs to said electronic controller.

31. The work vehicle of claim 30, wherein said first transmission is an infinitely variable transmission or a continuously variable transmission.

* * * * *